US005335714A

United States Patent [19]

Arvedi et al.

[11] Patent Number: 5,335,714

[45] Date of Patent: Aug. 9, 1994

[54] DUMMY BAR FOR CONTINUOUS CASTING INSTALLATIONS

[75] Inventors: Giovanni Arvedi, Cremona, Italy; Harald Lüdorff, Langenfeld, Fed. Rep. of Germany; Hans G. Thurm, Duisburg, Fed. Rep. of Germany; Lothar Parschat, Ratingen, Fed. Rep. of Germany; Fritz-Peter Pleschiutschnigg, Duisburg, Fed. Rep. of Germany; Hans-Joachim Paris, Düsseldorf, Fed. Rep. of Germany; Michael Steuten, Moers, Fed. Rep. of Germany

[73] Assignee: Mannesmann Aktiengesellschaft, Dusseldorf, Fed. Rep. of Germany

[21] Appl. No.: 84,195

[22] PCT Filed: Dec. 20, 1991

[86] PCT No.: PCT/DE91/01005

§ 371 Date: Sep. 3, 1993

§ 102(e) Date: Sep. 3, 1993

[87] PCT Pub. No.: WO92/11961

PCT Pub. Date: Jul. 23, 1992

[30] Foreign Application Priority Data

Jan. 4, 1991 [DE] Fed. Rep. of Germany ..... 4100365

[51] Int. Cl.[5] ..... B22D 11/08

[52] U.S. Cl. ..... 164/446; 164/426

[58] Field of Search ..... 164/445, 446, 425, 426

[56] References Cited

U.S. PATENT DOCUMENTS

| | | | |
|---|---|---|---|
| 3,451,466 | 6/1969 | Orr | 164/445 |
| 3,521,697 | 7/1970 | Niskovskikh et al. | 164/445 |
| 3,610,321 | 10/1971 | Khimich et al. | 164/445 |
| 5,197,533 | 3/1993 | Behrends | 164/426 |

FOREIGN PATENT DOCUMENTS

| | | | |
|---|---|---|---|
| 863158 | 9/1981 | U.S.S.R. | 164/426 |

*Primary Examiner*—P. Austin Bradley
*Assistant Examiner*—Jeffrey T. Knapp
*Attorney, Agent, or Firm*—Cohen, Pontani, Lieberman, Pavane

[57] ABSTRACT

The invention relates to a dummy bar for continuous casting installations with a curved bar guide arranged downstream of a mold. The invention provides a dummy bar which is characterized by a flexible metallic strip (1) and components (3) which are fastened to a surface of the strip (1) for detachably connecting with spacers (2) extending in the shape of strips along the width of the strip (1) on the same surface transversely to the longitudinal direction of the strip, which spacers (2) have mutually adjacent contact areas (6) at least in the region of the components (3). The free surface of the spacers (2) is covered with congruent rubber-like plates (5) and the free surface of the strip (1) is provided with a rubber-like coating (4).

7 Claims, 1 Drawing Sheet

DUMMY BAR FOR CONTINUOUS CASTING INSTALLATIONS

The invention relates to a dummy bar for continuous casting installations with a curved bar guide arranged downstream of a mold, in particular for producing steel billets in slab form.

Dummy bars for continuous casting installations having a curved guide are generally made from chain links connected by pins (DE-PS 12 90 606) or from flexible strips (U.S. Pat. No. 3,262,162). In U.S. Pat. No. 3,262,162, the necessary billet thickness, that is, the distance between the transporting rollers, is achieved by means of blocks fastened on the flexible strip. According to DE-PS 12 90 606, spring elements suitable for transmitting the conveying forces of the transporting rollers to the billet are arranged on the individual links of the starting chain in the event that the same dummy bar is to be used for different hot-billet thicknesses.

According to U.S. Pat. No. 3,610,321, it is already known that for purposes of transmitting the high conveying forces to the dummy bar the frictional engagement between the steel dummy bar and the steel transporting rollers has a negative influence on the life of the dummy bar and continuous-casting rollers. Therefore, in order to ensure frictional engagement with low bearing or contact pressure, it is suggested in U.S. Pat. No. 3,610,321 to install spring elements in the dummy bar and to cover the end face of the plates supported by the springs as well as the opposite surface at the dummy bar with a rubber-like material.

It is also known from DE-PS 11 35 621 to produce the dummy bar, in its entirety, from a flexible material which can possibly be fiber-reinforced. However, in the case of the two latter embodiment forms of dummy bars, it should be noted that the continuously flexible dummy bar is not suitable for the high conveying forces in slabbing installations, and in the embodiment form according to U.S. Pat. No. 3,610,321 the wear on the rollers when the rollers engage with the base body is not entirely satisfactory. Moreover, the embodiment form according to U.S. Pat. No. 3,610,321 is very costly and not suited for curved bar guides.

Therefore, the present invention has the object of providing a simply designed dummy bar which does not have the described disadvantages.

In a dummy bar of the generic type according to claim 1, this object is met according to the invention with the features of the characterizing part of claim 1. Advantageous further developments of the invention are indicated in the subclaims.

The dummy bar according to the invention is described in more detail with reference to an embodiment example.

Figure 1:
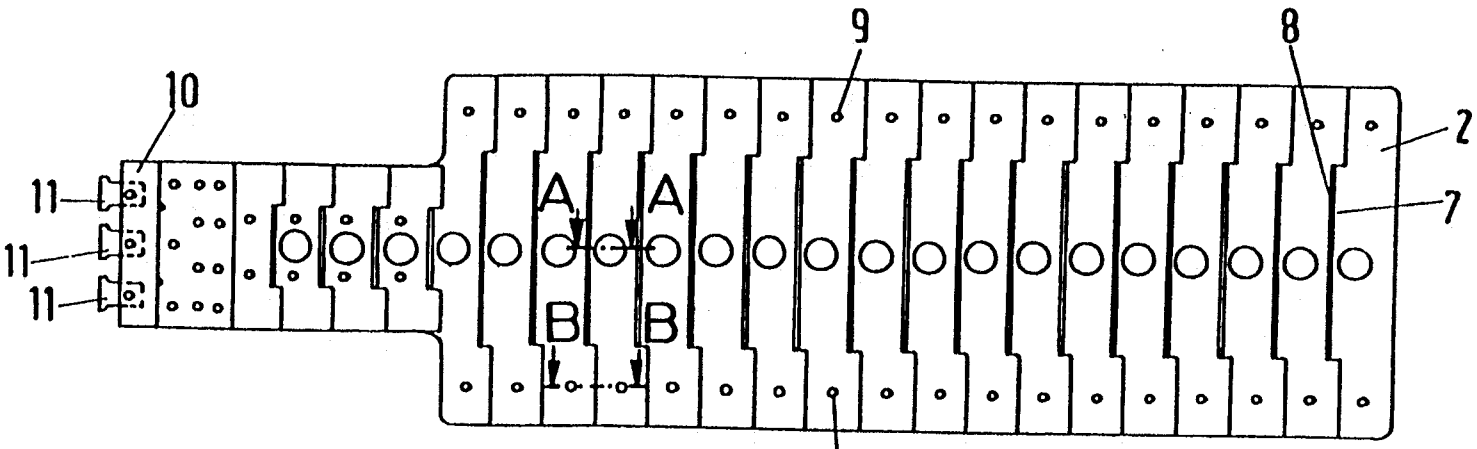
FIG. 1 shows a top view of a dummy bar.
Figure 2:
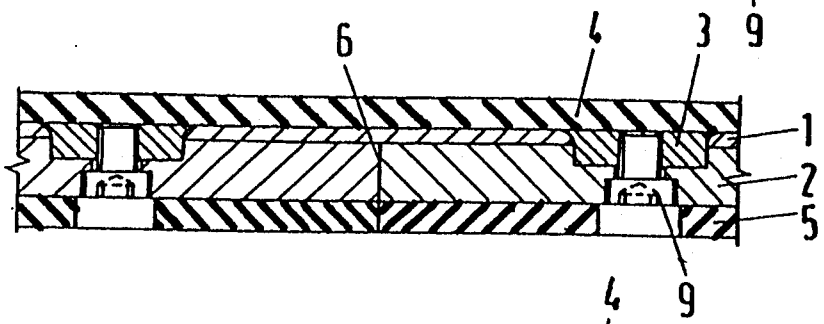
FIG. 2 shows a section B—B according to FIG. 1 in enlarged scale.
Figure 3:
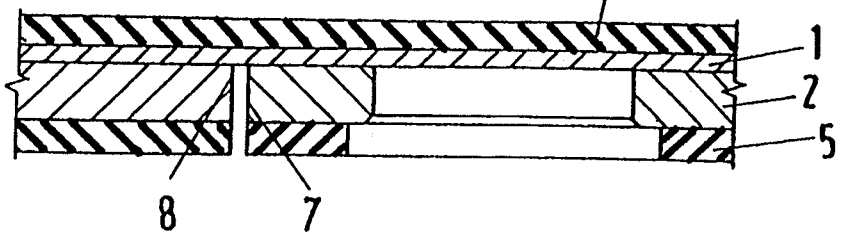
FIG. 3 shows a section A—A according to FIG. 1 in enlarged scale.

The dummy bar shown in FIG. 1 which is provided with a dummy bar head for connecting the dummy bar with the hot billet via connecting members 11 projecting into a mold, not shown, serves for extracting the hot billet from the mold. The dummy bar, including the hot billet situated thereon, is drawn through the bar guide by driven paired transporting rollers, the bar guide being likewise formed from pairs of rollers. As can be seen in particular from FIGS. 2 and 3, the dummy bar according to the invention is made from a flexible, metallic band or strip 1 determining the width of the dummy bar. Components 3 are arranged in the two edge regions of the metallic strip, these components 3 being inserted in recesses of the flexible strip in the present example and projecting out from the surface of the strip 1. Of course, these components 3 can also be fastened to a surface of the strip, e.g. by welding. The components 3 have threaded bores for fastening strip-shaped spacers 2 by means of screws 9, these spacers 2 extending transversely to the longitudinal direction of the strip. The spacers 2 extending transversely to the strip 1 have mutually adjacent contact areas 6 in the region of the connection members 3. The spacers 2 are constructed between the components 3 in such a way that one side of a spacer 2 is provided with a projection 7 which engages in a corresponding recess 8 of the adjoining spacer 2. The spacers 2 can lie at a distance from one another in this central region. The free surface of the spacers 2 is covered with rubber-like plates 5 which are congruent with the surface of the spacers. On the other hand, the free side of the flexible strip 1 is connected with a continuous rubber-like covering 4. The dummy bar and covering are preferably connected by gluing.

As concerns the present invention, rubber and rubber-like refer to highly-resilient, possibly fiber-reinforced material which possesses a higher friction coefficient than steel.

When passing through the curved guide frame, the dummy bar is positioned in such a way that the strip 1 with the rubber coating 4 faces the center of curvature, whereas the spacers with the rubber plates 5 constitute the outside curvature. As a result of the arrangement and construction of the spacers, the dummy bar is rigid against bending in one direction, but is nevertheless adapted to the curvature of the bar guide when passing through the curved guide frame.

The following advantages are achieved by the dummy bar according to the invention:

The dummy bar ensures that the transporting rollers maintain constant engagement with a material having a high frictional resistance. This enables a reduction in contact pressure forces and accordingly a lighter construction of the billet transporting device. Also, the dummy bar does not damage the transporting rollers, a direct contact of steel against steel is avoided, there is a reduction in the bending of the rollers due to the reduced contact pressure forces, and most of all the heavy wear on the rollers in the region of the dummy bar edges is reduced. This lengthens the life of the rollers and the ground roller profile is prevented from pressing into the hot billet and thus causing poor surfaces on the billet.

When the rubber plates are appropriately designed with respect to thickness, parabolically ground rolls can be used when a billet with cambered broadside surfaces is produced without the need to employ a specially constructed dummy bar for this special case.

Further, it is ensured that all driven rollers are continuously connected with the dummy bar and transmit their drive forces to the billet uniformly; a slipping of the rollers on the billet is prevented.

We claim:

1. Dummy bar for continuous casting installations with a curved bar guide fitted downstream of a mold, comprising a flexible metallic band (1), spacers (2) and components (3) which are fastened to a surface of the band (1) for detachably connecting the spacers (2) to the band, the spacers being strip-shaped and extending over the width of the band (1) on the band surface transversely to the longitudinal direction of the band, wherein the spacers (2) have mutually adjacent contact areas (6) at least in the region of the components (3) and the free surface of the spacers (2) is covered with congruent plates of highly-resilient material and the free surface of the band (1) is provided with a coating (4) of highly resilient material.

2. Dummy bar according to claim 1, wherein the band has edges that run in the longitudinal direction of the band, the components (3) being arranged in a region of the edges of the band (1).

3. Dummy bar according to claim 2, wherein a side of a spacer (2) is provided with a projection (7) which engages in a corresponding recess (8) of the adjoining spacer (2).

4. Dummy bar according to claim 1, wherein a side of a spacer (2) is provided with a projection (7) which engages in a corresponding recess (8) of the adjoining spacer (2).

5. Dummy bar according to claim 1, wherein the spacers (2) are connected with the strip (1) via the components (3) by means of screws (9).

6. Dummy bar according to claim 5, wherein the band has edges that run in the longitudinal direction of the band, the components (3) being arranged in a region of the edges of the band (1).

7. Dummy bar according to claim 5, wherein a side of a spacer (2) is provided with a projection (7) which engages in a corresponding recess (8) of the adjoining spacer (2).

* * * * *